US005478485A

United States Patent [19]

Bialas et al.

[11] Patent Number: 5,478,485

[45] Date of Patent: Dec. 26, 1995

[54] THERMALLY STABLE TEXTILE LUBRICANTS

[75] Inventors: Norbert Bialas, Dormagen; Raymond Mathis, Duesseldorf, both of Germany; Richard P. Crews, Simpsonville, S.C.; Elbert H. Mudge, Charlotte, N.C.; F. Norman Tuller, Simpsonville, S.C.

[73] Assignee: Henkel Kommanditgesellschaft auf Aktien, Duesseldorf, Germany

[21] Appl. No.: 260,854

[22] Filed: Jun. 16, 1994

[51] Int. Cl.$^6$ ..... D06M 13/148; C10M 105/22

[52] U.S. Cl. ..... 252/86; 106/243; 8/115.6

[58] Field of Search ..... 252/8.6, 56 R, 252/48.6; 8/115.6; 106/243

[56] References Cited

U.S. PATENT DOCUMENTS

| | | | |
|---|---|---|---|
| 3,963,628 | 6/1976 | Park | 252/8.8 |
| 4,066,558 | 1/1978 | Shay et al. | 252/8.9 |
| 4,069,160 | 1/1978 | Hawkins | 252/8.9 |
| 4,072,617 | 2/1978 | Jahn | 252/8.9 |
| 4,111,819 | 9/1978 | Muijs | 252/8.9 |
| 4,371,658 | 2/1983 | Marshall et al. | 252/8.9 |
| 4,400,281 | 8/1983 | Dehm | 252/8.6 |
| 4,871,592 | 10/1989 | Loewenstein et al. | 252/8.9 |
| 5,155,244 | 10/1992 | Greene et al. | 554/2 |

FOREIGN PATENT DOCUMENTS

WO9113134 9/1991 WIPO .

*Primary Examiner*—Anthony Green

*Attorney, Agent, or Firm*—Ernest E. Szoke; Wayne C. Jaeschke; Real J. Grandmaison

[57] ABSTRACT

Thermally stable textile lubricants suitable for spinning finishes based on polyol fatty acid esters, into which esters of thiocarboxylic acids corresponding to general formula (I) and/or (II):

$$R^1—S—R^2—COOH \quad (I)$$

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, are introduced to increase thermal stability, are distinguished by excellent thermal stability.

18 Claims, No Drawings

THERMALLY STABLE TEXTILE LUBRICANTS

FIELD OF THE INVENTION

This invention relates to thermally stable textile lubricants based on polyol fatty acid esters, small quantities of special thiocarboxylic acid esters being introduced to increase thermal stability. The invention also relates to spinning finishes containing these textile lubricants and to a process for the production of the thermally stable textile lubricants.

DISCUSSION OF RELATED ART

Spinning finishes are used in the production and processing of synthetic fibers. These spinning finishes all contain so-called textile lubricants to reduce friction between filaments or fibers and between filaments and guide elements. Polyolcarboxylic acid esters are being increasingly used as textile lubricants. The effect of the increasing automation of production processes has been that textile lubricants are having to meet extremely stringent requirements in regard to their thermal stability. Even the polyolcarboxylic acid esters which are known for their thermal stability are unable to satisfy these stringent requirements without further additives.

Accordingly, it has been proposed to use antioxidants, such as butylated hydroxytoluene (BHT) because compounds such as these effectively improve thermal stability, even in small to medium quantities. Unfortunately, BHT and related antioxidants show relatively high volatility at the temperatures which occur in the production and processing of textile fibers. As a result, antioxidants of this class rapidly volatilize and are only able to perform their function, namely to prevent oxidative damage to the textile lubricant, for a limited initial period and not throughout the process as a whole.

It has also been proposed to use sterically hindered phenols as antioxidants, one example of such an antioxidant being the commercially available product Irganox 1010 which is known to the expert and which is characterized by relatively low volatility. Unfortunately, this approach is attended by the disadvantage that antioxidants belonging to this group show only limited solubility in the esters. This means that the necessary concentration of dissolved antioxidant cannot be adequately achieved.

WO 91/13134 describes a process for improving the solubility of antioxidants in lubricants, the antioxidant being incorporated in a carrier medium via covalent bonds. In its preferred embodiment, the teaching of WO 91/13134 states that so-called superstable lubricants are obtained when the percentage content of covalently bonded antioxidant in the carrier medium is greater than 0 to 30% by weight. In the Examples, the percentage content of covalently bonded antioxidant in the carrier medium is 10 to 20% by weight. A textile lubricant in which 10% by weight of Irganox 1010 is covalently bonded to pentaerythritol pelargonate as carrier is mentioned as an example of a particularly suitable product. However, it is both economically and ecologically desirable to minimize the content of antioxidants.

DESCRIPTION OF THE INVENTION

Other than in the operating examples, or where otherwise indicated, all numbers expressing quantities of ingredients or reaction conditions used herein are to be understood as modified in all instances by the term "about".

The problem addressed by the present invention was to provide thermally stable textile lubricants which would avoid the above-mentioned disadvantages of the prior art. More particularly, the problem addressed by the invention was to provide thermally stable textile lubricants which would only require a minimal percentage content of antioxidants.

According to the invention, this problem has been solved by lubricants based on polyol fatty acid esters into which esters of thiocarboxylic acids corresponding to general formula (I) and/or (II):

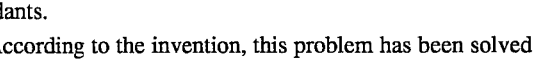

$$R^1—S—R^2—COOH \quad (I)$$

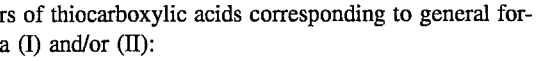

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, are introduced to increase thermal stability.

In a first embodiment, therefore, the present invention relates to thermally stable textile lubricants suitable for spinning finishes based on polyol fatty acid esters, wherein esters of thiocarboxylic acids corresponding to general formula (I) and/or (II):

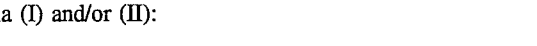

$$R^1—S—R^2—COOH \quad (I)$$

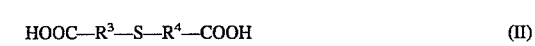

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, are introduced to the polyol fatty acid esters in quantities of 0.05 to 8% by weight, based on polyol fatty acid ester, to increase thermal stability.

The polyols and the fatty acids of the polyol fatty acid esters may be saturated or olefinically unsaturated and may have a linear or branched carbon chain.

The substituents $R^1$ to $R^4$ may be saturated or olefinically unsaturated, linear or branched where they are alkyl or cycloalkyl groups or the alkyl moiety of an alkaryl group.

In the context of the invention, polyols are understood to be polyhydric alcohols containing at least two OH groups. Basically, there are no particular limitations to the chemical constitution of the polyols, i.e. they may be linear or even branched. The polyols are preferably selected from the group consisting of glycerol, trimethylol propane, neopentyl glycol and pentaerythritol.

The fatty acid components of the polyol fatty acid esters are preferably derived from fatty acids containing 8 to 18 carbon atoms which, in addition, are preferably saturated. According to the invention, the best effects are obtained when fatty acids containing 8 to 10 carbon atoms are used as the fatty acid component. These particular acids are known to the expert as caprylic acid, pelargonic acid and capric acid. These acids may be used either individually or in the form of mixtures. Mixtures of $C_8$ and $C_{10}$ fatty acids are known as so-called head-fractionated fatty acids.

Preferred thiocarboxylic acid esters are esters of thiocarboxylic acids in which the thiocarboxylic acids corresponding to general formula (I) and/or (II) are esterified with monohydric aliphatic alcohols containing 1 to 22 carbon atoms, neopentyl glycol, glycerol, trimethylol propane or pentaerythritol. The polyhydric alcohols neopentyl glycol, glycerol, trimethylol propane and pentaerythritol may be pure or even mixed esters. "Pure" esters are understood to be esters in which all the hydroxyl groups of the polyhydric alcohols are esterified with one or more thiocarboxylic acids corresponding to general formula (I) and/or (II). "Mixed" esters are understood to be esters in which at least one hydroxyl group is esterified with a thiocarboxylic acid corresponding to general formula (I) or (II). The other hydroxyl groups are esterified with fatty acids containing 6 to 22 carbon atoms as described in reference to the polyol fatty acid esters. The esters of monohydric aliphatic alcohols of the described type and the "pure" esters of pentaerythritol are particularly preferred. Among the monohydric aliphatic alcohols, n- and i-butanol, 2-ethylhexanol, isotridecyl alcohol, lauryl alcohol, isostearyl alcohol and/or oleyl alcohol are particularly suitable.

Among the thiocarboxylic acids corresponding to general formula (I), those in which $R^1$ is a $C_{6-18}$ alkyl group and $R^2$ is a $C_1$ or $C_2$ alkyl group are preferred. Particularly suitable examples are β-lauryl thiopropionic acid ($C_{12}H_{25}SCH_2CH_2COOH$) and β-octyl thiopropionic acid ($C_8H_{17}SCH_2CH_2COOH$).

Of the thiocarboxylic acids corresponding to general formula (II), those in which $R^3$ and $R^4$ represent a $C_2$ alkyl group, i.e. thiodipropionic acid ($HOOCCH_2CH_2SCH_2CH_2COOH$), are preferred.

The esters of thiocarboxylic acid are commercially available compounds which may also readily be obtained by known esterification reactions. The mixed esters may readily be obtained by transesterification of the pure thioacid esters with the described fatty acids.

In the production of the thermally stable textile lubricants according to the invention the thiocarboxylic acid esters are used in a quantity of 0.05 to 8% by weight, based on the weight of the polyol fatty acid esters. In a preferred embodiment, the thiocarboxylic acid esters are used in a quantity of 0.5 to 5% by weight and, more particularly, in a quantity of 1.0 to 3.0% by weight. These figures for the quantities used are based on the above-defined quantities of pure thiocarboxylic acid esters. In the case of mixed thiocarboxylic acid esters, larger quantities have to be used in accordance with the thiocarboxylic acid content of the ester. The thiocarboxylic acid esters are introduced into the polyol fatty acid esters. In one embodiment of the present invention, the thiocarboxylic acid esters are stirred into the polyol fatty acid esters at temperatures of 20° to 80° C. In this embodiment, the thiocarboxylic acid esters may be stirred into the heated polyol fatty acid esters or, alternatively, the thiocarboxylic acid esters are added to the polyol fatty acid esters and the whole is heated with stirring. In a second and preferred embodiment, the polyol fatty acid esters are reacted with the esters of the thiocarboxylic acids corresponding to general formula (I) and/or (II) at temperatures of 90° to 170° C. in the presence of a transesterification catalyst. Suitable transesterification catalysts are tin-based compounds, such as tin octoate, and sodium methylate. The transesterification catalysts are present in a quantity of 0.01 to 2% by weight, based on the total quantity of polyol fatty acid ester and thiocarboxylic acid ester.

In another and particularly preferred embodiment of the present invention, antioxidants are additionally introduced as an additive into the lubricants according to the invention. The antioxidants are added with or after the introduction of the thiocarboxylic acid esters which preferably takes place at temperatures of 90° to 170° C. in the presence of the transesterification catalysts. Accordingly, the present invention also relates to a process for the production of thermally stable textile lubricants based on polyol fatty acid esters, wherein the polyol fatty acid esters are reacted with 0.05 to 8% by weight, based on polyol fatty acid ester, of esters of thiocarboxylic acids corresponding to general formula (I) and/or (II):

$$R^1—S—R^2—COOH \quad (I)$$

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, at temperatures of 90° to 170° C. in the presence of a transesterification catalyst and optionally in the presence of additional antioxidants. The additional antioxidants may be present in the process from the outset or may be added during or even after the process.

Suitable antioxidants are butylated hydroxytoluene, dialkyl or diaryl phosphonates, trialkyl or triaryl phosphites, ascorbic or citric acid and derivatives thereof and, in particular, sterically hindered phenols.

Compounds A-1 to A-6 shown below are mentioned as special examples of sterically hindered phenols suitable for the purposes of the invention. Irganox 1010, Irganox 1076, Irganox 1098, Irganox 245 and Irganox 259 are commercially available from Ciba-Geigy Co., and Cyanox 1790 from Cytec.

Irganox 1010 A-1
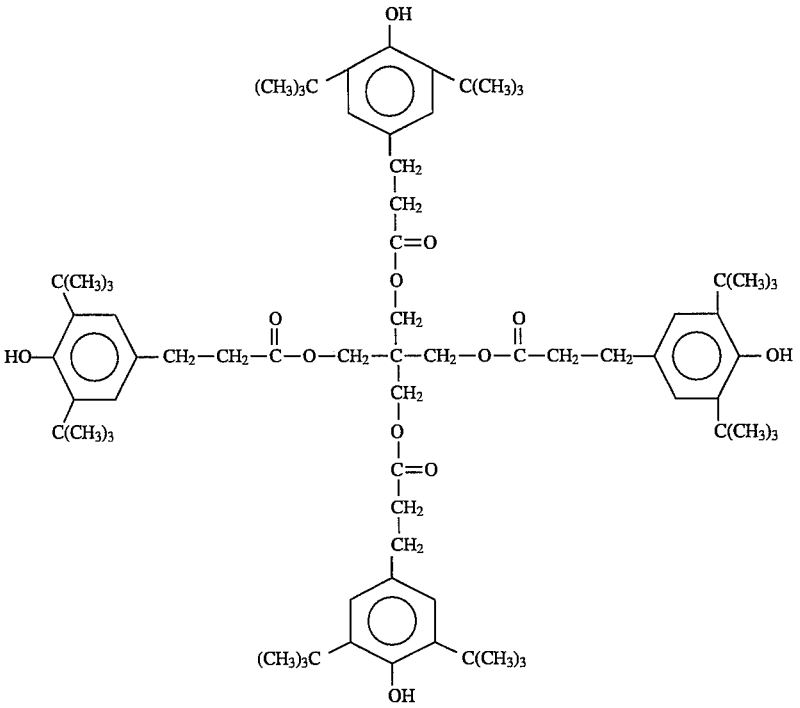
Irganox 1076 A-2
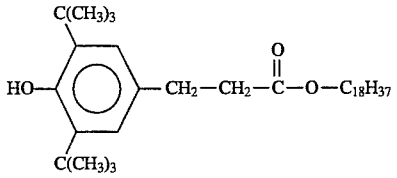
Irganox 1098 A-3
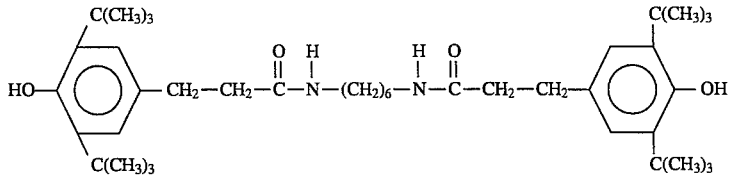
Irganox 245 A-4
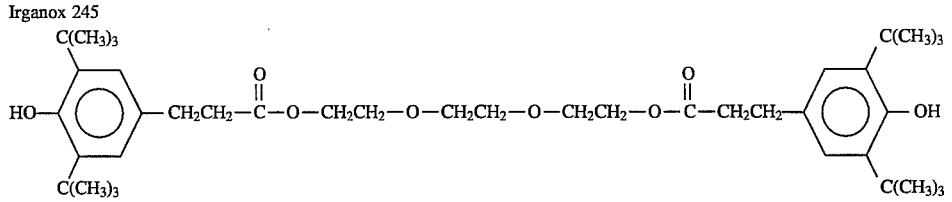
Irganox 259 A-5
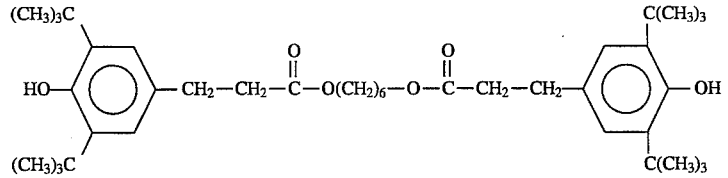

-continued

Cyanox 1790 A-6

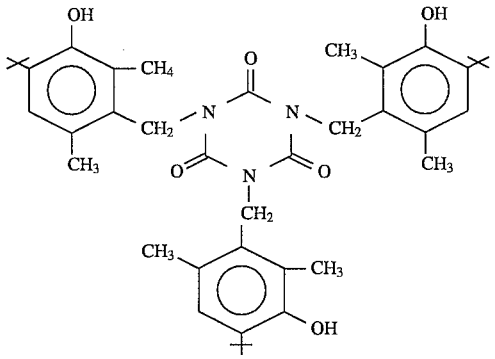

In a particularly preferred embodiment, an antioxidant of structure A-1 and/or A-6 is used as an additional sterically hindered phenol.

The additional additives ensure that the already good thermal stability of the textile lubricants according to the invention is synergistically further improved. This is reflected inter alia in the fact that considerably smaller quantities of the antioxidants than described, for example, in WO 91/13134 (10 to 20% by weight) are sufficient to obtain comparable thermal stabilities. For example, even quantities of 1.0% by weight of the sterically hindered phenol Irganox 1010, based on the total quantity of polyol fatty acid esters and thiocarboxylic acid esters, produce excellent thermal stabilities.

Generally speaking, it is advisable in accordance with the invention to use the antioxidants in a quantity ratio to the thiocarboxylic acid esters of 1:1 to 1:4. In the case of the sterically hindered phenols, particularly good results are obtained with quantities of the additional antioxidants of 10 to 50% by weight, based on the thiocarboxylic acid esters, quantities of 20 to 30% by weight being particularly preferred.

By virtue of their high thermal stability, the textile lubricants according to the invention with and without additional antioxidants may be used inter alia in spinning finishes. Accordingly, the present invention also relates to spinning finishes for synthetic filaments, characterized in that they contain the described thermally stable textile lubricants. The textile lubricants may in turn contain the additional antioxidants. The spinning finishes contain the textile lubricants in a quantity of at least about 35% by weight. Further components of the spinning finishes may be emulsifiers, wetting agents and/or antistatic agents and the auxiliaries known from the prior art, such as filament compacting agents, pH regulators, bactericides and/or corrosion inhibitors.

Suitable emulsifiers, wetting agents and/or antistatic agents are anionic, cationic and/or nonionic surfactants, such as monoglycerides and/or diglycerides, for example glycerol monooleate and/or glycerol dioleate, alkoxylated, preferably ethoxylated and/or propoxylated, fats and oils, $C_{8-24}$ fatty alcohols and/or $C_{8-18}$ alkylphenols, for example adducts of 25 moles of ethylene oxide with castor oil and/or adducts of 8 moles of propylene oxide and 6 moles of ethylene oxide with $C_{16-18}$ fatty alcohols, optionally alkoxylated $C_{8-24}$ fatty acid monoethanolamides and/or diethanolamides, for example optionally ethoxylated oleic acid monoethanolamide and/or diethanolamide, tallow fatty acid monoethanolamide and/or diethanolamide and/or coconut oil fatty acid monoethanolamide and/or diethanolamide, alkali metal and/or ammonium salts of alkoxylated, preferably ethoxylated and/or propoxylated, optionally end-capped $C_{8-22}$ alkyl and/or $C_{8-22}$ alkylene alcohol sulfonates, reaction products of optionally alkoxylated $C_{8-22}$ alkyl alcohols with phosphorus pentoxide or phosphorus oxychloride in the form of their alkali metal, ammonium and/or amine salts, for example phosphoric acid esters of ethoxylated $C_{12-14}$ fatty alcohols, neutralized with alkanolamine, alkali metal and/or ammonium salts of $C_{8-22}$ alkylsulfosuccinates, for example sodium dioctylsulfosuccinate, and/or amine oxides, for example dimethyl dodecylamine oxide. It is important to remember in connection with this exemplary list that a number of the compounds mentioned are capable of performing not just one function, but several functions. For example, an antistatic agent may also act as an emulsifier.

Other optional components may be any of the usual auxiliaries. Suitable filament compacting agents are the polyacrylates, fatty acid sarcosides and/or copolymers with maleic anhydride known from the prior art. Suitable pH regulators are $C_{1-4}$ carboxylic acids and/or $C_{1-4}$ hydroxycarboxylic acids, for example acetic acid and/or glycolic acid, alkali metal hydroxides, such as potassium hydroxide, and/or amines, such as triethanolamine; bactericides and/or corrosion inhibitors may also be present.

The spinning finishes according to the invention may be prepared by intensive mixing of the textile lubricants according to the invention, optionally with the emulsifiers, wetting agents, antistatic agents and optionally with the usual auxiliaries, at temperatures of around 18° to 25° C.

As usual in the textile industry, the spinning finishes are applied in the form of aqueous dispersions to the synthetic filament fibers immediately when they emerge from the spinneret. The spinning finishes, which have a temperature of 18° to 60° C., are applied by means of applicator rolls or at metering points via suitable applicators. Spinning finishes in the form of aqueous dispersions with a total active substance content of around 3 to 40% by weight and, more particularly, between 5 and 30% by weight are preferred. Based on the total active substance content, the spinning finishes according to the invention contain a) 35 to 100% by weight of the textile lubricant according to the invention, b) 0 to 65% by weight of emulsifiers, antistatic agents and/or wetting agents, c) 0 to 10% by weight of pH regulators, bactericides and/or corrosion inhibitors, the quantities being selected so that they add up to 100% by weight.

EXAMPLES

1. Pentaerythritol tetrapelargonate (PETP) and 5% by weight of pentaerythritol tetrakisoctyl thiopropionate 1,330 g of PETP and 70 g of pentaerythritol tetrakisoctyl thiopropionate were heated to 90° C. in a three-necked flask equipped with a stirrer, reflux condenser and nitrogen inlet pipe. 3.5 g of a 25% by weight sodium methylate solution were then added and the whole was stirred for about 1 hour at 90 to 100° C. before phosphorous acid was added for neutralization. A pale yellow liquid was obtained. For working up, the product was washed with water to a pH value of the washing water of 7.1 to 7.3, dried and bleached.

2. PETP and 4% by weight of pentaerythritol tetrakisoctyl thiopropionate and 1% by weight of Irganox® 1010

The procedure was as in Example 1 using 56 g of pentaerythritol tetrakisoctyl thiopropionate and 14 g of Irganox® 1010.

3. PETP and 2% by weight of diisotridecyl thiodipropionate and 1% by weight of Irganox® 1010

The procedure was as in Example 1 using 1,358 g of PETP, 28 g of diisotridecyl thiodipropionate and 14 g of Irganox® 1010.

What is claimed is:

1. Thermally stable textile lubricants suitable for spinning finishes, said lubricants comprising polyol fatty acid esters and from about 0.05 to about 8% by weight of esters of thiocarboxylic acids corresponding to a general formula selected from the group consisting of formula (I), formula (II), and mixtures thereof:

$$R^1—S—R^2—COOH \quad (I)$$

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, based on the weight of said polyol fatty acid esters.

2. Lubricants as in claim 1 wherein the polyols of said polyol fatty acid esters are selected from the group consisting of neopentyl glycol, glycerol, trimethylol propane and pentaerythritol.

3. Lubricants as in claim 1 wherein the fatty acids of said polyol fatty acid esters contain 8 to 18 carbon atoms and are optionally saturated.

4. Lubricants as in claim 1 wherein the fatty acids of said polyol fatty acid esters are selected from the group consisting of caprylic acid, pelargonic acid and capric acid.

5. Lubricants as in claim 1 wherein said thiocarboxylic acids are esterified with an alcohol selected from the group consisting of monohydric aliphatic $C_{1-22}$ alcohols, neopentyl glycol, glycerol, trimethylol propane and pentaerythritol.

6. Lubricants as in claim 1 wherein, in formula (I), $R^1$ is a $C_{6-18}$ alkyl group and $R^2$ is a $C_1$ or $C_2$ alkyl group.

7. Lubricants as in claim 1 wherein, in formula (II), $R^3$ and $R^4$ represent a $C_2$ alkyl group.

8. Lubricants as in claim 1 wherein said thiocarboxylic acid esters are present in a quantity of 0.5 to 5% by weight, based on said polyol fatty acid esters.

9. Lubricants as in claim 1 further containing an antioxidant.

10. Lubricants as in claim 9 wherein said antioxidant is present in a quantity ratio to said thiocarboxylic acid esters of 1:1 to 1:4.

11. A spinning finish composition for synthetic filaments containing the textile lubricants of claim 1.

12. A process for the production of thermally stable textile lubricants containing polyol fatty acid esters, comprising reacting said polyol fatty acid esters with about 0.05 to 8% by weight, based on the weight of said polyol fatty acid esters, of esters of thiocarboxylic acids corresponding to a general formula selected from the group consisting of formula (I), formula (II) and mixtures thereof:

$$R^1—S—R^2—COOH \quad (I)$$

$$HOOC—R^3—S—R^4—COOH \quad (II)$$

in which $R^1$, $R^2$, $R^3$ and $R^4$ may be the same or different and represent an alkyl, cycloalkyl, aryl or alkaryl group containing 1 to 22 carbon atoms, at a temperature of about 90° to about 170° C. in the presence of a transesterification catalyst, and optionally in the presence of an antioxidant.

13. The process as in claim 12 wherein the polyols of said polyol fatty acid esters are selected from the group consisting of neopentyl glycol, glycerol, trimethylol propane and pentaerythritol.

14. The process as in claim 12 wherein the fatty acids of said polyol fatty acid esters contain 6 to 22 carbon atoms.

15. The process as in claim 12 wherein in formula (I), $R^1$ is a $C_{6-18}$ alkyl group and $R^2$ is a $C_1$ or $C_2$ alkyl group.

16. The process as in claim 12 wherein in formula (II), $R^3$ and $R^4$ represent a $C_2$ alkyl group.

17. The process as in claim 12 wherein said transesterification catalyst is selected from the group consisting of tin octoate and sodium methylate and is present in a quantity of about 0.01 to about 2% by weight, based on the quantity of said polyol fatty acid ester and thiocarboxylic acid ester.

18. The process as in claim 12 including the step of adding a sterically hindered phenol antioxidant to said lubricants.

* * * * *